United States Patent [19]

Hembise

[11] Patent Number: 4,848,236

[45] Date of Patent: Jul. 18, 1989

[54] MINE WITH INDIRECT FIRING FOR ATTACKING ARMOURED VEHICLES

[75] Inventor: Dominique Hembise, Plaisir, France

[73] Assignee: Matra, Paris, France

[21] Appl. No.: 124,620

[22] Filed: Nov. 24, 1987

[30] Foreign Application Priority Data

Nov. 27, 1986 [FR] France ..... 86 16578

[51] Int. Cl.[4] ..... F42B 23/04

[52] U.S. Cl. ..... 102/427; 102/213; 89/41.08

[58] Field of Search ..... 102/211, 213, 214, 374, 102/427; 89/41.08

[56] References Cited

U.S. PATENT DOCUMENTS

| | | | |
|---|---|---|---|
| 2,925,965 | 2/1960 | Pierce | 102/213 |
| 3,642,233 | 2/1972 | Bezerie | 102/213 |
| 4,160,415 | 7/1979 | Cole | 102/214 |
| 4,245,560 | 1/1981 | Rambauske | 102/213 |
| 4,398,466 | 8/1983 | Sepp et al. | 102/427 |
| 4,611,540 | 9/1986 | Pettersson et al. | 102/374 |
| 4,676,166 | 6/1987 | Spies et al. | 102/427 |
| 4,703,694 | 11/1987 | Corbett et al. | 102/374 |

FOREIGN PATENT DOCUMENTS

| | | | |
|---|---|---|---|
| 3543840 | 7/1987 | Fed. Rep. of Germany | 102/427 |
| 2185556 | 7/1987 | United Kingdom | 102/213 |

OTHER PUBLICATIONS

Klass, "Microprocessor Controls Antitank Skeet", *Aviation Week & Space Tech.,* Mar. 22, 1982, pp. 66–69.

*Primary Examiner*—Deborah L. Kyle
*Assistant Examiner*—Michael J. Carone
*Attorney, Agent, or Firm*—Stevens, Davis, Miller & Mosher

[57] ABSTRACT

A mine for use against armored vehicles has a mount with a base resting on the ground and an ammunition launching tube having a fixed elevation and carried by the base for rotation about a vertical axis. The base contains a system for detection and azimuth location of targets which uses both seismic and acoustic detection. The tube is aimed in azimuth toward the target and an anti-tank ammunition is fired toward the position where the distance between the mine and the target is minimum. The ammunition consists of a self-propelled missile which will fly over the target at a high speed. The motor of the missile spins it about its roll axis. The self forging charge of the missile has an axis transversal to the roll axis. The missile has a detection system including a sensor which scans the ground about the roll axis and causes firing of the charge when aligned with the target.

11 Claims, 3 Drawing Sheets

MINE WITH INDIRECT FIRING FOR ATTACKING ARMOURED VEHICLES

BACKGROUND OF THE INVENTION

1. Field of the Invention

The invention relates to indirectly fired mines having a large firing range, called zone action mines, for engaging armoured vehicles, including a mount with a base containing a system for detection and azimuth localization of targets by seismic and acoustic means and at least one ammunition launching tube; the system is adapted to aim the tube azimuthally and an antitank ammunition is fired with a fixed elevation towards the position where the distance between the mine and the target is minimum.

2. Description of the Prior Art

Mines of the above-defined type with indirect firing have already been proposed whose main advantage over directly fired mines is that they do not require a direct hit by the ammunition and so a direct view, which interferes with camouflage. Among the indirectly fired mines already proposed may be mentioned the zone action aerodispersed mine "ERAM" which uses ammunition called "skeet"; among other drawbacks, it is only efficient if the target passes at a short distance from the mine.

A mine is also known (German Patent 23 36 040) whose firing tubes are aimed both in azimuth and in elevation; the ammunition is for direct hit which requires the field of firing of the mine to be clear. French 2 518 734 describes a number of theoretical mine designs, one of which includes tubes whose elevation is fixed. Each projectile has a detector for scanning the ground along a spiral path when it falls suspended on a parachute. The ammunition is not self propelled and its explosive charge is directed along the main axis of the ammunition. The lack of initial aiming and of dual detection results into a system which is very heavy and the efficiency of which is poor.

SUMMARY OF THE INVENTION

To overcome this drawback, there is provided a mine in which the missile is self propelled by means which spin it about its roll axis, contains a self forging charge (SFF) having its firing axis, transversal to a roll axis of the missile and is provided with target detection means using scanning about the roll axis, causing detonation of the charge when it is directed towards the target.

A SFF has the advantage of being efficient along the firing axis over a distance of about 100 calibers; since the missile is self propelled, it retains a high speed (several tens of meters per second) over its whole travel and its flight time to the target is shorter than that of a projectile fired by a propulsive charge contained in the tube; this high speed reduces the distance of miss collision and the response time of the system. Through firing with a fixed value of the elevation (which is retained approximately during the flight since the missile is self propelled), the scanned width on the ground (for a predetermined effective scanning angle of the detection means about the roll axis) increases with the flight time, which compensates for the increased possible deviation.

The detection means advantageously include an infrared sensor or an active millimetric wave directional sensor for rotational scanning about the roll axis, along a direction in advance on the axis of the SFF. In the case of an infrared sensor, a comparison circuit confirms the output signal of the sensor to indicate the presence of a target when the signal has a duration and a threshold greater than predetermined values, to avoid firing at false targets. The sensor is advantageously responsive to two separate wavelength ranges and is associated with a circuit for correlation of the two measurements. Advantageously, this circuit is responsive to the output signal of the sensor in a predetermined downwardly directed angular range only. The comparison circuit may use additional criteria for enabling the output signal of the sensor, such as the shape of the signal.

If an active millimetric sensor is used, firing of the charge under out-of-range conditions is more readily prevented since the distance between the missile and the target is known.

The self-propelling means of the missile typically accelerate the missile up to its cruising speed in a very short period of time and then delivers a thrust compensating for the drag for maintaining the cruising speed. The missile may have a stabilizing tail unit formed with spreadable fins, mounted on the body by a bearing so as not to be driven in rotation. The fins may have a curved shape which makes it possible to hold them applied against the body of the missile unit it has left the launching tube.

In a modified embodiment, the antitank missile has a single stage with fixed nozzles and its spinning motion is maintained during the flight time by the tail unit. In this configuration, the tail unit is fixed to the body at a suitable angle so as to provide the rotational drive torque. Such a missile is simpler than the preceding one.

The means for aiming the tube in azimuth are typically arranged to aim the tube only when the location system indicates that the target has just passed the position where its angular speed is maximum, so as to reduce as much as possible the energy consumption of the aiming system.

BRIEF DESCRIPTION OF THE DRAWINGS

The invention will be better understood from the following description of a particular embodiment, given by way of example. The description refers to the accompanying drawings in which.

DESCRIPTION OF A PREFERRED EMBODIMENT

Figure 1:
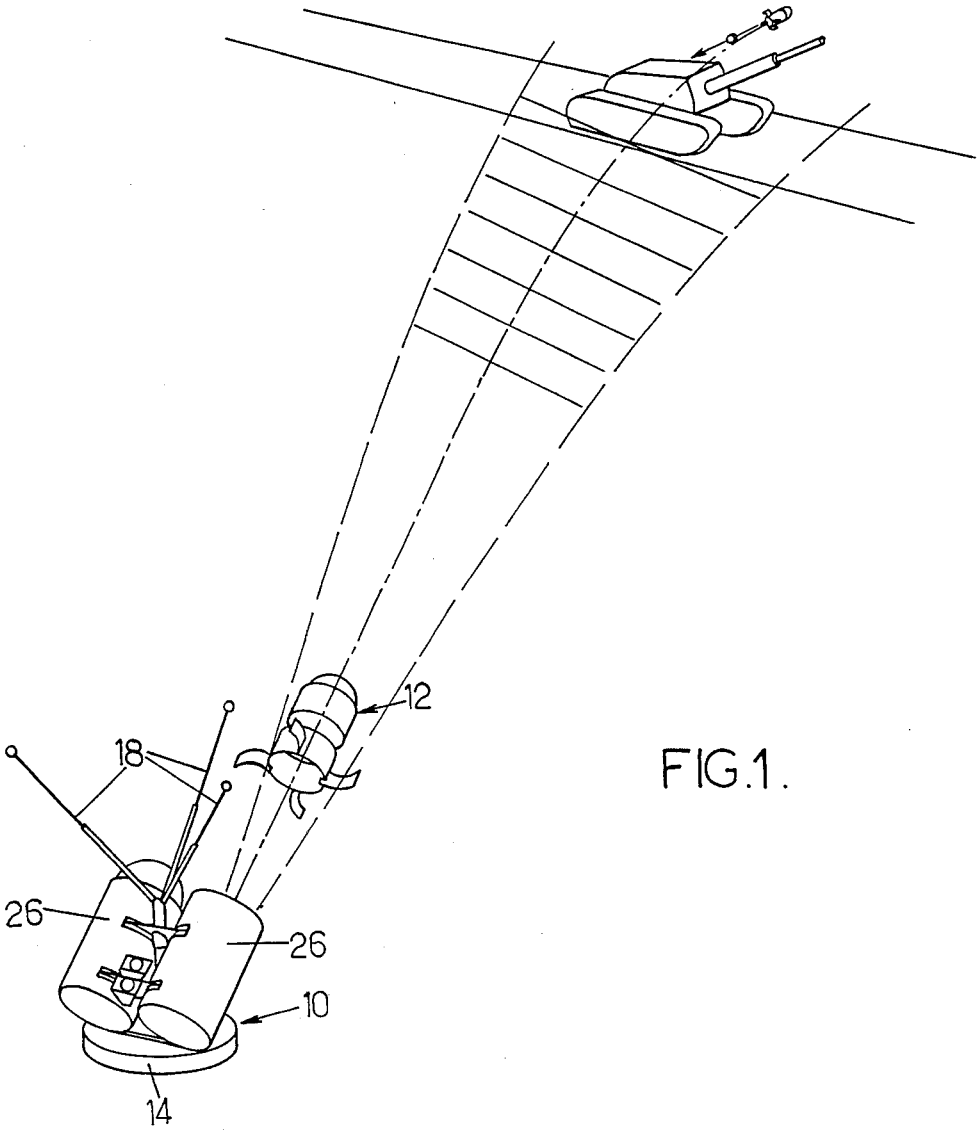
FIG. 1 is a diagrammatical perspective view showing a mine of the invention and the trajectory of a missile.
Figure 2:
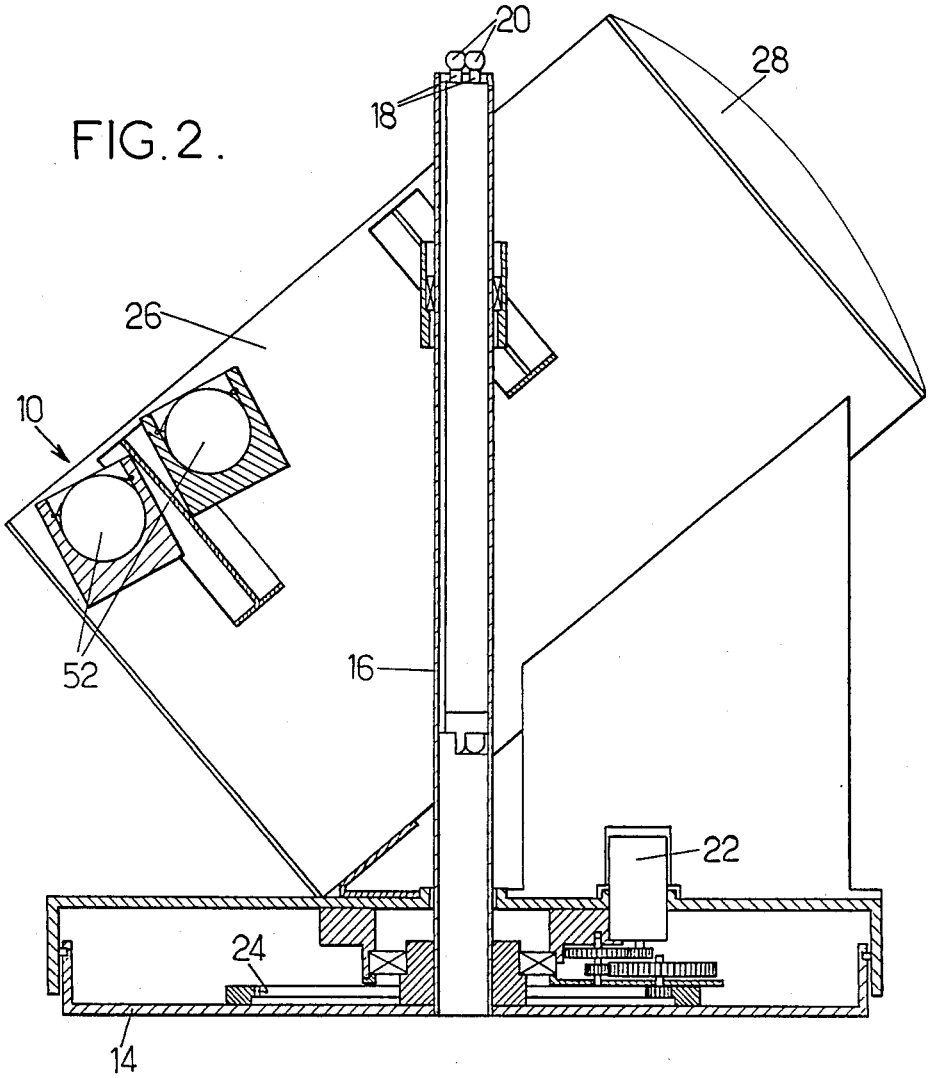
FIG. 2 is a schematical view of the mine in elevation and partially in cross-section.
Figure 3:
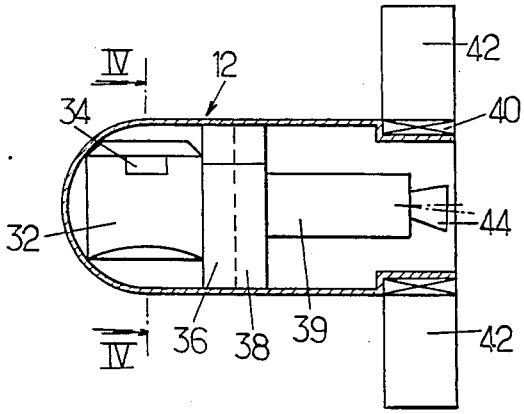
FIG. 3 is a simplified view of a missile, in partial cross-section along a plane passing through its axis.

Referring to FIGS. 1 to 3, a mine includes a mount 10 and two self-propelled rounds of ammunition 12.

The mount 10 includes a fixed base 14 which rotatably supports a turret adjustable in azimuth about an axis defined by a central tube 16. During transport, the tube is used to store three acoustic antennae for localization and detection, carrying microphones 20. When they are spread out, these antennae are spaced angularly apart about the axis (FIG. 1) for acoustic location by measuring the phase angle between signals received. For that, the base 14 contains electronic circuits (not shown) which also receive signals from a seismic sensor for detecting targets. The active components contained in the mount are fed by a battery of accumulators (not shown), typically a lithium battery.

The turret includes an orientation motor 22 connected by a step down gear train to a toothed wheel 24 of the base. It includes two tubes 26 mounted with fixed elevation, for example 40°, closed by sealing lids 28 ejected upon firing. The tubes may be made from composite material (resin and coiled fibers). Each tube 26 may have a missile retention finger, which is rendered inoperative upon firing the propulsive charge. To give the mine a range of action of about 100 m, with firing at an elevation of 40°, the tube caliber will typically be greater than 200 mm.

Each antitank missile 12 (FIG. 3) includes a case 30 containing, from the front to the rear:

a core generation or self-forming charge (SFF) 32 whose caliber may be 150 mm for a missile of 220 mm diameter, having its axis transversal to the roll axis of the projectile, having a firing device 34;

a proximity detection and firing control device 36 having a directional infrared sensor or a millimetric wave sensor and processing electronics;

an electric power source 38 typically a percussion activated thermal battery responsive to acceleration of the missile;

a propulsive unit 39 having a solid propellant with two successive operating modes, an acceleration mode of short duration (0.4 sec for example) with high thrust for bringing the missile to its permanent flight speed, usually about 40 m/s, and a cruising mode during which the thrust compensates for the drag at this speed.

Missile 12 has a stabilizing tail unit connected to the casing by a ball bearing 40. In the embodiment illustrated, this tail unit has a support ring and four curved fins 42, folded onto the ring when the missile is in the tube and which open out on leaving the tube.

The propuslive unit 39 is arranged to spin the missile 12 continuously and steadily about the roll axis for causing ground scanning by the infrared sensors at a speed of about 16 rps for a speed of 40 m/s. For that, it may comprise two nozzles 44 placed side by side and slightly inclined in opposite directions.

In the case of infrared sensing, the detection device 36 advantageously has two directional sensors each having an angular range of sensitivity of about 30 mrads, operating in different wave length ranges so as to allow correlation for eliminating false targets. The sensors may be a Pb-Se sensor, sensitive in the 3.6–4.9 μm band and a Pb S sensor, sensitive between 1.6 and 2.7 μm. The aiming axis 46 of the sensors is offset angularly forwardly by a few degrees with respect to that of the charge since, as will be seen later on, the device causes firing after it has roughly checked the distance of the target by processing the signal obtained through scanning of the whole target.

If a millimetric wave sensor is used, it may be an active sensor operating at 35 or 94 GHz whose angular range is of about 30 mrads, with a device for eliminating false targets; the aiming direction of the sensor is also offset with respect to that of the charge; firing is allowed only if the distance to the target measured by the detection device is smaller than a predetermined threshold.

Figure 5:
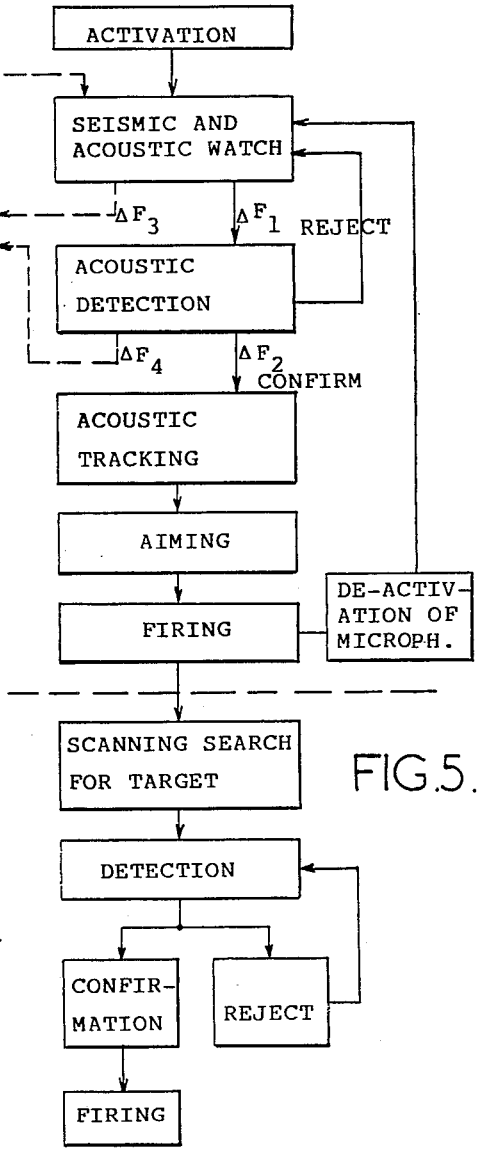
FIG. 5 is an operation flow sheet.
Figure 4:
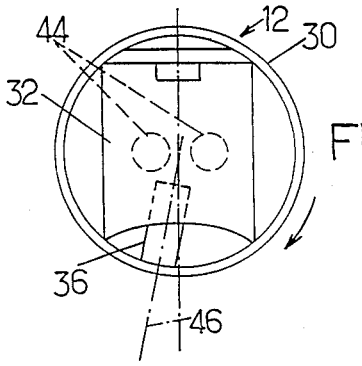
FIG. 4 is a view of the missile in partial cross-section along line IV—IV of FIG. 3.

The operating flow chart of the mine may be as shown in FIG. 5.

Once laid and activated (activation being possibly remotely controlled), the mine is in seismic and acoustic watching mode. Seismic sensors available at the present time make it possible to detect a tracked vehicle at about 200 m and a wheeled vehicle at about 100 m. The signal from the seismic sensor is fed to a filter having a pass band $\Delta F_1$ corresponding to the range of frequency predominantly caused by a vehicle. When the signal transmitted by the seismic sensor exceeds a given threshold, it causes acoustic search by the three microphones 20. The signal from the acoustic sensors (microphones) is filtered with a band $\Delta F_2$ and, if it exceeds a predetermined threshold, activates a circuit for locating and acoustically tracking the target. This location is achieved by measuring the phase difference between the signals received by the microphones 20 having fixed positions. The location and tracking circuit calculates the angular position of the target with respect to the mount and the angular speed of the target.

The angular speed first increases and later begins to decrease. Then (and only then), the aiming mechanism is energized. For that, the locating and tracking circuit determines the azimuth aiming angle from the angular speed. The firing line must be in front of the target in the direction of movement thereof, the angle of advance being chosen for a mean distance in the range of action of the mine.

As soon as the angle is determined, the servocontrol circuit pivots the turret to aim the launching tubes 26. Since aiming only takes place at the last moment, the stored energy is best used. By adopting a high aiming speed, of about 360°/s, the delay in aiming is without detrimental consequence.

As soon as tubes 26 are stopped in aimed condition, the activation device of the mine fires the propulsive charge of one of the missiles 12 and at the same time inhibits, for a given period (one second for example), the detection and tracking device so as to avoid the consequences of the saturation of the sensors by the noise of the propulsive unit.

The missile, fired with a predetermined fixed elevation, reaches its cruising speed in a fraction of a second. The sensor immediately angularly scans the space around the missile. If infrared detection is used, the difference of brightness of the sky and the ground makes it possible to limit the angular zone taken into account to 100° or so, corresponding to the zone shown by broken lines in FIG. 1. For a rotational speed of 16 rps and a speed of 40 m/s, the successive ground traces of the scan are sufficiently close together so that any target met with is scanned by the sensors 36.

To avoid firing of charge 32 at a target which is too far away, the detection device is advantageously provided for processing the signal received. In the case of an active millimetric wave device, a distance information is available; firing at a target which is too far away is easily avoided.

Figure 6:
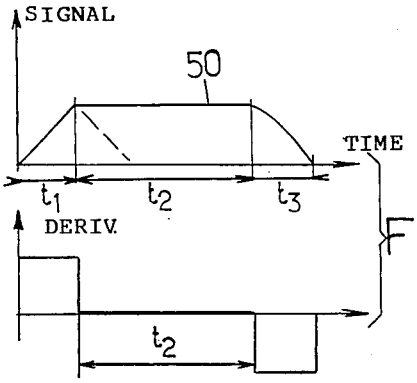
FIG. 6 is a diagram showing the shape of signals appearing during scanning of a target, when an infrared sensor is used.

In the case of infrared means, discrimination may be based on the shape of the signal delivered by the infrared sensors. The criterion of detection is based on the fact the signal s delivered by the sensor does not vary in time in the same way if the target is in the plane of flight of the missile or laterally located. In the case of a target over which the projectile flies directly, the signal will have the general shape shown at 50 in FIG. 6. The signal has successively a rising edge $t_1$, a level plateau of duration $t_2$ and a downward edge of duration $t_3$. On the other hand, a target at the lateral range limit results in a signal as shown in broken line in FIG. 6, without a plateau. To differentiate signal 50 from signals corresponding to targets to be discarded, the signal s may be derived. The derived signal d is formed of two square waves separated by a time interval $t_2$. The criterion of validation will then be the presence of two square waves of opposite signs separated by a time interval of a duration greater than a given minimum value.

The mine shown schematically in FIGS. 1 and 2 includes additional means for preventing undesirable de-activation and removal.

For that, the mine 10 includes two ejectable antipersonnel projectiles 52. The projectiles are fired by the seismic detection circuit using the same sensor as that of the antitank device but with band pass filtering in a range $\Delta F_3$ different from $\Delta F_1$. Seismic antipersonnel detection may be completed by acoustic detection, in a frequency range $\Delta F_4$. Initiation by seismic or acoustic detection causes the ejection of a grenade after automatic orientation of the turret. The device may be arranged so that any movement of the mine causes firing of the remaining antitank missile(s) once the two antipersonnel devices have been fired. The electronics may be wired so that firing of the second antitank missile causes destruction or short circuiting of the set of filters of the processing electronics.

Figure 7:
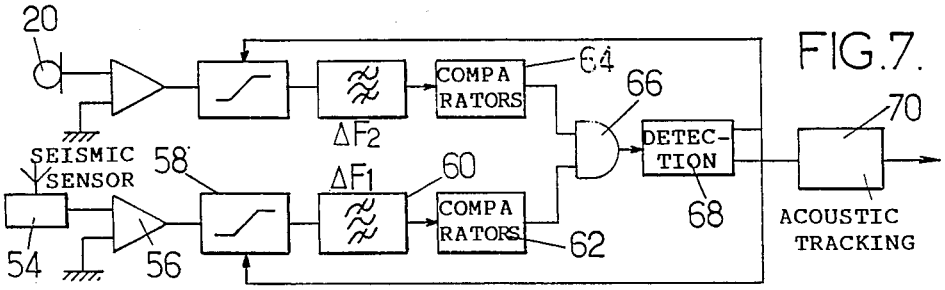
FIG. 7 is a diagram showing a possible arrangement of the detection means of the mine shown in FIG. 1.

FIG. 7 shows a general construction of the part of the detection means which is used for firing the antitank missiles.

A seismic detection channel includes a seismic sensor 54 which may be of conventional type, whose output signal is applied to a differential preamplifier 56. The output signal of the preamplifier is applied to a threshold circuit 58 which passes on the signals having a value greater than a given value to a pass-band filter 60 having a pass band $\Delta F_1$. A comparator 62 delivers an output logic signal if the amplitude of the analog signals delivered by filter 60 exceeds a given value, which may be adjustable.

An acoustic detection channel may have a structure comparable to that of the seismic channel which has just been described. The signals delivered by one of the microphones 20 (or the set of three microphones mounted in parallel relation) are subjected to preamplification, threshold detection, filtering and comparison. The output signal of the comparator 64 is applied to one of the inputs of an AND gate 66 which also receives the signal delivered by comparator 62. In addition to selection by a frequential table of truth, correlation may be provided between the ratios of acoustic and seismic levels in different characteristic frequency bands. Correlation may be made by a microprocessor.

The appearance of an AND 66 logic signal, confirmed by calculation made by the correlation microprocessor, causes a detection circuit 68 to deliver an acoustic tracking order, shown at 70, and temporary interruption of the watch.

Acoustic tracking, shown schematically at 70, involves using the microphones 20 differently from that described hereinbefore. Through an acoustic tracking interruption switch and respective filtering circuits, the signals from the microphones 20 are applied to the three inputs of a phase comparator from which the angular position of the target is determined. Aiming then takes places as already described. Firing causes switches to open, for a time corresponding to the approximate flight time of the projectile (one second for example), so as to interrupt acoustic tracking.

I claim:

1. Indirectly fired mine for use against armored vehicles, comprising: a mount having a stationary base, at least one ammunition round launching tube having a predetermined elevation angle above ground and mounted on said base for azimuthal movement thereon; motor means for azimuthal aiming of said tube; and a system contained in said base for seismic and acoustic detection and azimuth location of targets, said system comprising means for determining that location of a movable target at which the angular speed of the target is maximum and controlling said motor means for aiming said location; and an ammunition having a roll axis and comprising (i) propelling means for spinning said ammunition about its roll axis, (ii) a self forging charge having a firing axis transversal to said roll axis and (ii) target detection means located on the ammunition for scanning the ground about the roll axis and for causing detonation of the charge when it is directed toward the target.

2. Mine according to claim 1, wherein said detection means include (i) a directional infrared sensor for rotational scanning around the roll axis and having its sensing axis in advance on the axis of the charge in, the direction of spinning said sensor comprising means for delivering a signal when said sensing axis is directed toward a target, and (ii) a comparison circuit indicating the presence of a target when said signal has a length duration higher than a predetermined value.

3. Mine according to claim 2, wherein said sensor is responsive to two separate wavelength ranges and is associated with a circuit for correlating measurements in said two ranges.

4. Mine according to claim 2, wherein said comparison circuit uses the shape of the signal as a criterium for enabling the output signal.

5. Mine according to claim 1, wherein said self-propelling means are arranged to operate as a booster for accelerating the ammunition to a cruise speed from rest within a time duration shorter than the overall flight duration of the ammunition by at least one order of magnitude and as a cruise motor having a thrust which just compensates the drag during the remaining portion of the flight.

6. Mine according to claim 5, wherein said self-propelling means comprises a power motor having two symmetrically located output nozzles which are at an angle with the roll axis.

7. Mine according to claim 1, wherein said ammunition further includes a stabilization tail unit having a bearing carried by a body of the ammunition for free rotation about the roll axis with respect to the body and foldable fins carried by said bearing.

8. Mine according to claim 1, wherein said detection means comprises an active sensor operating in the millimetric wave range for rotational scanning about the roll axis and means responsive to a distance information provided by the sensor for preventing firing at remote targets.

9. Mine according to claim 1, wherein said system includes acoustic means for said detection and azimuth location of targets and seismic detection means for enabling said acoustic means.

10. Mine according to claim 1, wherein said predetermined elevation angle is about 40°.

11. Indirectly fired mine for use against armored vehicles, comprising:

a mount having a stationary base, at least one ammunition round launching tube having a predetermined elevation angle and mounted on said base for azimuthal movement thereon; motor means for azimuthal aiming of said tube; and a system contained in said base for acoustic detection and azimuth location of targets, said system comprising means for determining that location of a movable target at which the angular speed of the target is maximum and controlling said motor means for aiming at said location after detection of said maximum angular speed has occurred; and an ammunition having a roll axis and comprising (i) propelling means for spinning said ammunition about its roll axis, (ii) a self forging charge having a firing axis transversal to said roll axis and (iii) target detection means located on the ammunition for scanning the ground about the roll axis and for causing detonation of the charge when it is directed toward the target.

* * * * *